US008858866B2

(12) United States Patent
Andreatta et al.

(10) Patent No.: US 8,858,866 B2
(45) Date of Patent: Oct. 14, 2014

(54) COOLING TANK FOR RAILS

(75) Inventors: Daniele Andreatta, Borso del Grappa (IT); Alfredo Poloni, Fogliano Redipuglia (IT); Marco Schreiber, Brescia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 309 days.

(21) Appl. No.: 13/261,028

(22) PCT Filed: May 20, 2010

(86) PCT No.: PCT/EP2010/056964
§ 371 (c)(1),
(2), (4) Date: Dec. 28, 2011

(87) PCT Pub. No.: WO2010/133666
PCT Pub. Date: Nov. 25, 2010

(65) Prior Publication Data

US 2012/0098171 A1 Apr. 26, 2012

(30) Foreign Application Priority Data

May 20, 2009 (IT) ..... M12009A0892

(51) Int. Cl.
*C21D 1/62* (2006.01)
*C21D 1/63* (2006.01)
*C21D 9/04* (2006.01)

(52) U.S. Cl.
CPC ... *C21D 9/04* (2013.01); *C21D 1/63* (2013.01)
USPC ..... 266/44; 266/112; 266/134

(58) Field of Classification Search
CPC ..... C21D 1/63; C21D 9/04; C21D 9/06
USPC ..... 266/44, 134, 112, 130
See application file for complete search history.

(56) References Cited

U.S. PATENT DOCUMENTS

| | | | | |
|---|---|---|---|---|
| 2,143,753 | A | 1/1939 | Blage | |
| 3,380,725 | A * | 4/1968 | Gubert et al. | 266/117 |
| 8,226,883 | B2 * | 7/2012 | Koeck et al. | 266/112 |
| 2003/0047852 | A1 | 3/2003 | Kock et al. | |
| 2011/0272867 | A1 * | 11/2011 | Poloni et al. | 266/259 |
| 2012/0098171 | A1 * | 4/2012 | Andreatta et al. | 266/44 |

FOREIGN PATENT DOCUMENTS

| | | |
|---|---|---|
| GB | 211441 | 10/1924 |
| GB | 290182 | 7/1929 |
| GB | 451961 | 8/1936 |
| GB | 619699 | 3/1949 |
| JP | 59222531 | 12/1984 |

* cited by examiner

*Primary Examiner* — Scott Kastler
(74) *Attorney, Agent, or Firm* — Stetina Brunda Garred & Brucker

(57) ABSTRACT

A cooling tank for the thermal treatment of the head of rails, whose frame allows obtaining a stable and on average uniform flow of the cooling fluid which touches the head of the immersed rail along the entire tank, with the continuous exchange of the fluid so as to optimize the cooling speed of the head of the rail.

16 Claims, 8 Drawing Sheets

COOLING TANK FOR RAILS

FIELD OF THE INVENTION

The present invention relates to a cooling tank, in particular to a tank suitable for cooling rails in a thermal treatment installation of the rail heads.

STATE OF THE ART

Various system solutions for the thermal treatment of rolled rails are considered in the known art, aiming in particular to obtain the hardening of the head by means of a tempering operation.

Many of these systems are not arranged immediately at the output from the rolling mill. This results in storing the rolled rails and their successive heating before proceeding with the thermal tempering treatment, with significant energy consumption and low performances.

The rolled rail is picked up by manipulators, comprising complex linkages, which manage the handling of the rail during the thermal treatment that this undergoes; and finally it is expelled on the plate or cooling bed by means of suitable expulsion mechanisms.

The head of the heated rails are subjected to a rapid cooling either by means of spray nozzles, which inject a cooling fluid (water, air, or water mixed with air) onto the head of the rail, or by immersing the same head in a cooling tank containing a cooling fluid.

In the case the cooling tank is used to immerse the head of the rail, there is a greater cooling evenness in the direction of the length with respect to the solution with spray nozzles, but several problems arise, including:

- the non-continuous exchange of the cooling fluid which touches the head of the rail does not permit obtaining good control of the temperature of the fluid and therefore an optimum thermal exchange;
- the decreasing level of the cooling fluid in the tank, caused by the immersion of successive rails, does not permit obtaining optimum tempering of the head of the rails successive to the first;
- during the tempering treatment, the flow of the cooling fluid in the tank is subject to some turbulences, with formations of vortexes which do not permit uniforming the cooling speed of the head of the immersed rail;
- the supply of the fluid along the entire length of the tank is not uniform and therefore the fluid dynamics is not optimized;
- the current tanks do not have restraint conditions thus permitting the thermal dilatation thereof with consequential deformations which compromise the regularity of the fluid level;
- cleaning the tank requires burdensome manual interventions.

Thus the need is felt to make a cooling tank which allows overcoming the aforesaid drawbacks.

SUMMARY OF THE INVENTION

It is the primary object of the present invention to make a cooling tank, for the thermal treatment of the head of rails, whose geometry allows obtaining a stable upwards and on average uniform flow of the cooling fluid which touches the head of the rail along the entire tank with a continuous exchange of the fluid itself so as to uniform the cooling speed of the head of the rail and the temperature of the cooling fluid.

Another object of the invention is to provide an efficient operating method for said cooling tank.

A further object of the invention is to provide a washing method of said cooling tank which allows simply and effectively both a completely automatic washing of the moduli of the tank during short stops of the installation, and a partially automatic washing of the moduli of the tank during the production cycle of the installation.

Therefore, the present invention proposes achieving the afore-discussed objects by making a cooling tank for thermal treatment of a head of a rail, defining a longitudinal axis, which, according to claim 1, comprises a plurality of longitudinal moduli connected in succession to each other in correspondence to their ends, wherein each of said longitudinal moduli is provided with:

- a frame comprising a first volume to be filled with a cooling fluid wherein the head of the rail to be treated is immersed;
- a delivery manifold for the inlet of the cooling fluid, placed in a lower area of said first volume;

wherein said delivery manifold is provided with a fork with two longitudinal sections parallel to said longitudinal axis, which extend till side ends of the modulus and which are closed in correspondence to said side ends;

and wherein said longitudinal sections have two opposed side walls provided with a respective plurality of gauged holes so that a substantially even distribution of the discharge coming out of said gauged holes is obtained, thus allowing an evenness of the cooling fluid flow along each modulus.

A second aspect of the present invention provides an operating method of the aforesaid cooling tank, which, according to claim 15, comprises the following steps:

- continuously flowing in of the cooling fluid in the delivery manifolds of each modulus at a predetermined first pressure;
- flowing out of said cooling fluid into the lower area of the first volume of each modulus, at a predetermined second pressure at least equal to the piezometric charge exerted by an impending hydraulic head of the fluid through the plurality of gauged holes of the longitudinal sections of said delivery manifolds, so that a substantially even distribution of the flow coming out of said gauged holes is obtained, thus allowing an evenness of flow of the cooling fluid along each modulus.

A further aspect of the present invention provides a washing method of the aforesaid cooling tank, which, according to claim 16, comprises the following steps:

a) opening a discharge pipe provided on the bottom of each modulus of the tank by means of a respective opening/closing valve and discharging, at least partial, of the fluid present in the modulus;

b) closing said respective opening/closing valve.

Said washing method may be provided automatically and permits partially washing the moduli of the tank during the production cycle of the installation, thus taking advantage of the inter-billet time between one rail and the successive.

Instead, an advantageous variant of the aforesaid washing method permits performing complete automatic washing of the moduli of the tank during brief stops of the installation, such as for example during the replacement of the rolling machine cylinders. In this case, a shutdown of at least one delivery pump of the delivery circuit of the cooling fluid is provided before step a); the delivery of new cooling fluid into the delivery manifolds is provided between step a) and step b) by means of the activation of said at least one delivery pump to carry out a free rinse of the bottom of each modulus to get rid of the residual scale; and the delivery of new cooling fluid into the delivery manifolds is provided after stage b) by means of the activation of said at least one delivery pump to carry out the filling of the tank and to restore its operativeness.

The cooling tank according to the invention has the following advantages:

- a constant thermal exchange due to the continuous exchange of the cooling fluid which touches the head of the rail;
- the constancy of the level in the tank due to the side overflow of the cooling fluid;
- a relative fluid-surface speed of the head of the rail which permits having a uniform cooling rate;
- a modular frame of the tank with uniformity of the flow of the cooling fluid along each modulus and along the entire length;
- sliding blocks allowing a thermal dilatation of the tank;
- a precise levelling, with respect to the horizontal, of the tank along the entire length thereof;
- the possibility of automatically washing the moduli to remove the scale which falls in the tank during the thermal treatment.

The dependent claims describe preferred embodiments of the invention.

BRIEF DESCRIPTION OF THE FIGURES

Further features and advantages of the invention shall be more apparent in light of the detailed description of preferred, but not exclusive, embodiments of a cooling tank, disclosed by way of a non-limiting example, with the aid of enclosed drawings in which.

DETAILED DESCRIPTION OF PREFERRED EMBODIMENTS OF THE INVENTION

Figure 1A:
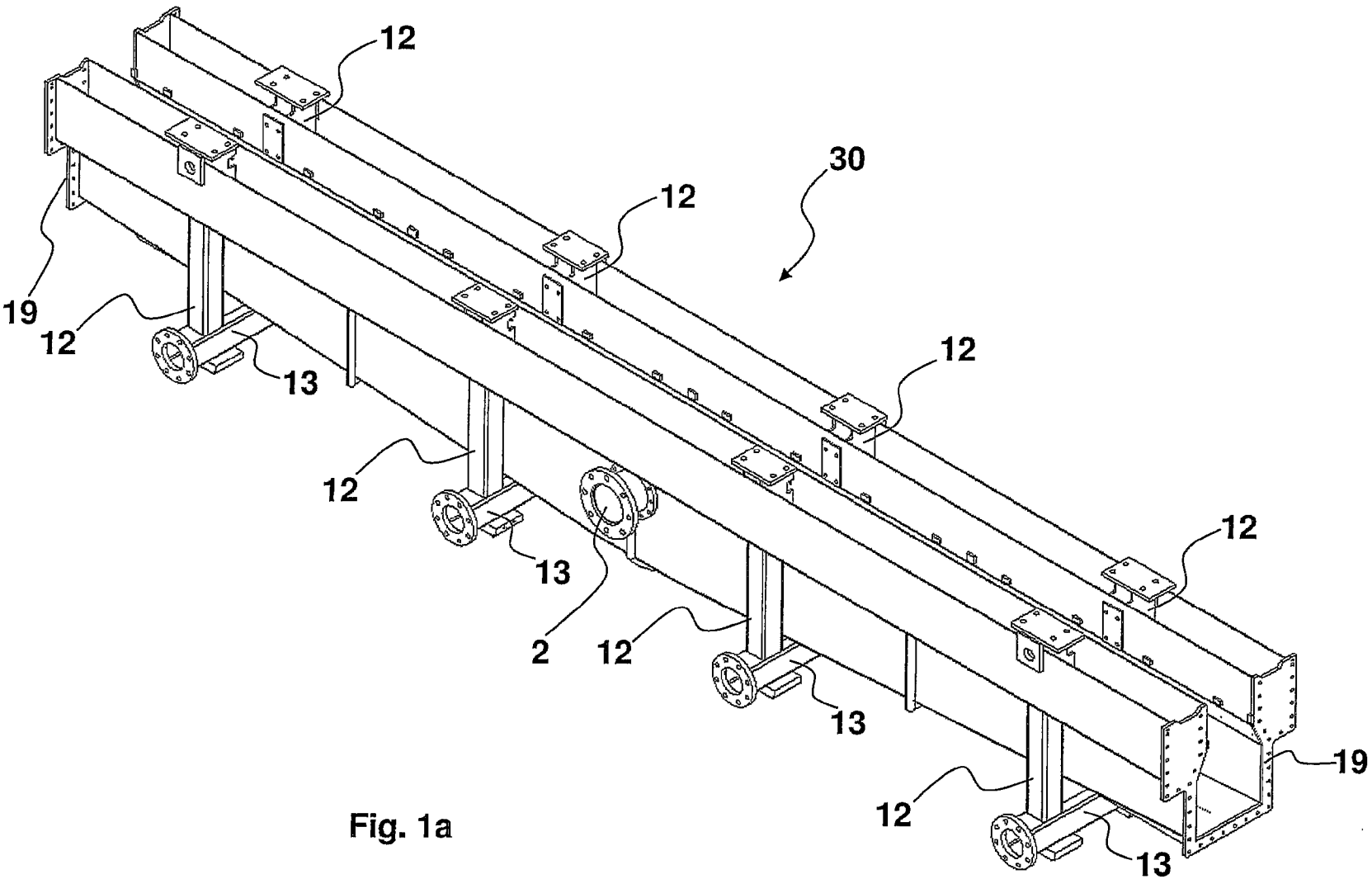
FIG. 1*a* shows a perspective view of the external frame of a modulus of the cooling tank according to the invention.
Figure 1B:
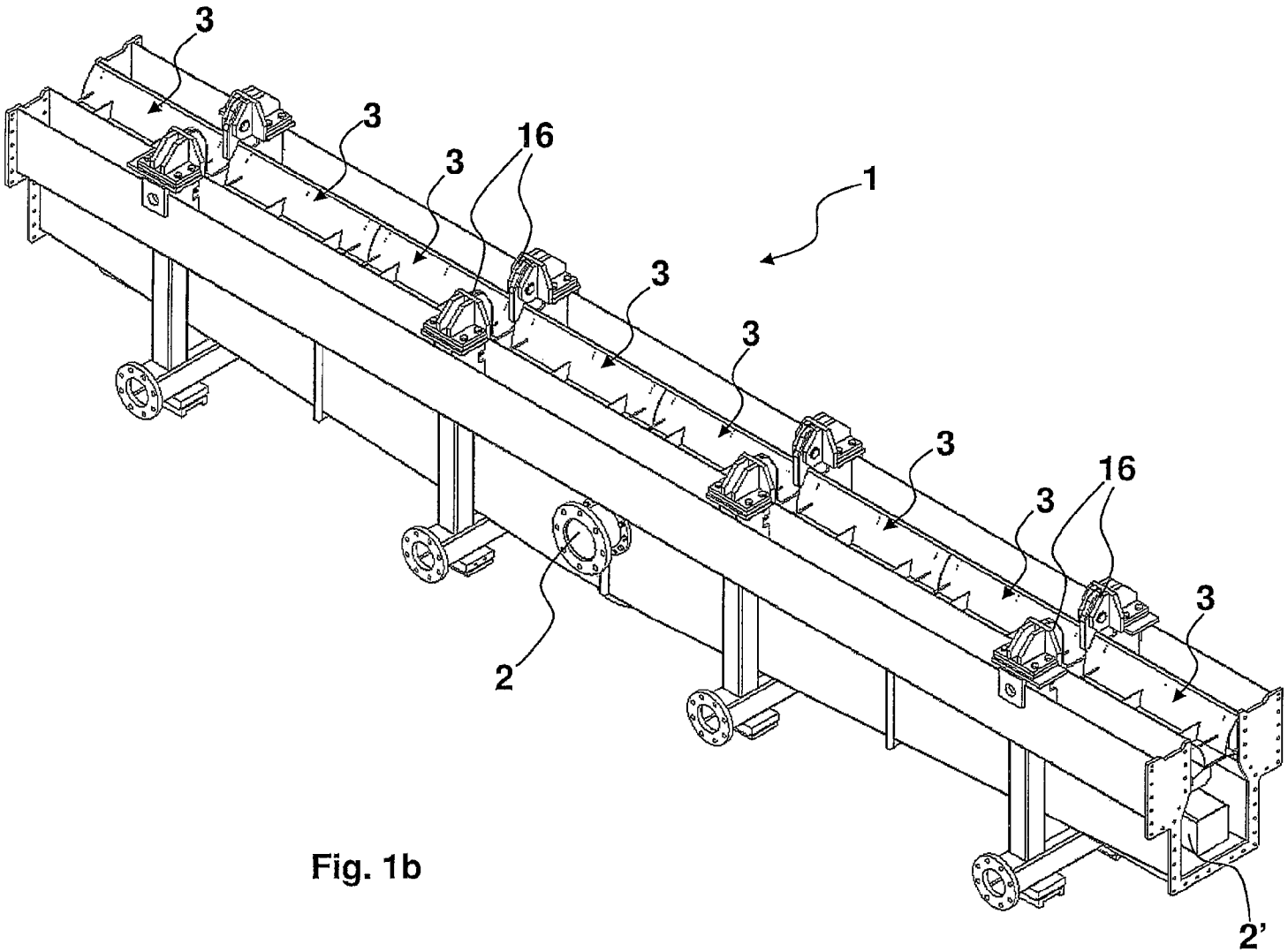
FIG. 1*b* shows a perspective view of a complete modulus of the cooling tank according to the invention.

With reference to FIGS. 1 to 4, a preferred embodiment of a modulus 1 of a cooling tank for the thermal treatment of the head of rails is shown, object of the present invention.

The cooling tank, defining a longitudinal axis, comprises a plurality of longitudinal moduli 1, connected to each other by means of flanges or other suitable connecting means. The longitudinal extension and the number of said moduli 1 are such as to define a total length of the cooling tank greater than the length of the rail to be thermally treated by immersing the head into the tank.

E.g., according to a variant of the tank of the invention, eighteen moduli 1 are have a length of 6 meters for a total tank length equal to 108 meters. Such a tank is capable of treating rails whose length is up to 107 m to obtain a finished product of 100 m net of the length tolerances of the bloom before rolling, of the thermal shrinkage of the rail during the treatment, of rail head and tail cropping after the treatment.

According to another variant, twenty-one moduli 1 may be provided to obtain a tank length of 126 meters to treat rails up to 120 m in order to obtain a finished product of 108 m.

Advantageously sliding blocks are provided on the moduli in longitudinal direction to allow any thermal expansion of the tank. Only the modulus or the central moduli are locked without the possibility of moving.

Each modulus 1 is provided with a base frame 30 comprising:

- a central volume 31 where the cooling fluid is continuously inlet and the head of the rail to treat is immersed;
- and two side volumes 32 where the cooling fluid is collected which overflows from the top of the central area 31.

The two side volumes 32 are provided with discharge pipes 12 along their extension. Such pipes 12 are arranged with each other in the two side volumes 32 so that each couple of corresponding pipes 12 is connected to a transversal pipe 13 provided below the bottom of the modulus 1 (FIG. 1*a*). The cooling fluid already used for the thermal treatment of the rail flows, through the pipes 12, to the pipes 13 connected to a blow-by circuit of the cooling fluid. The pipes 12 and 13 also perform a structural support function of the cooling tank.

Figure 8:
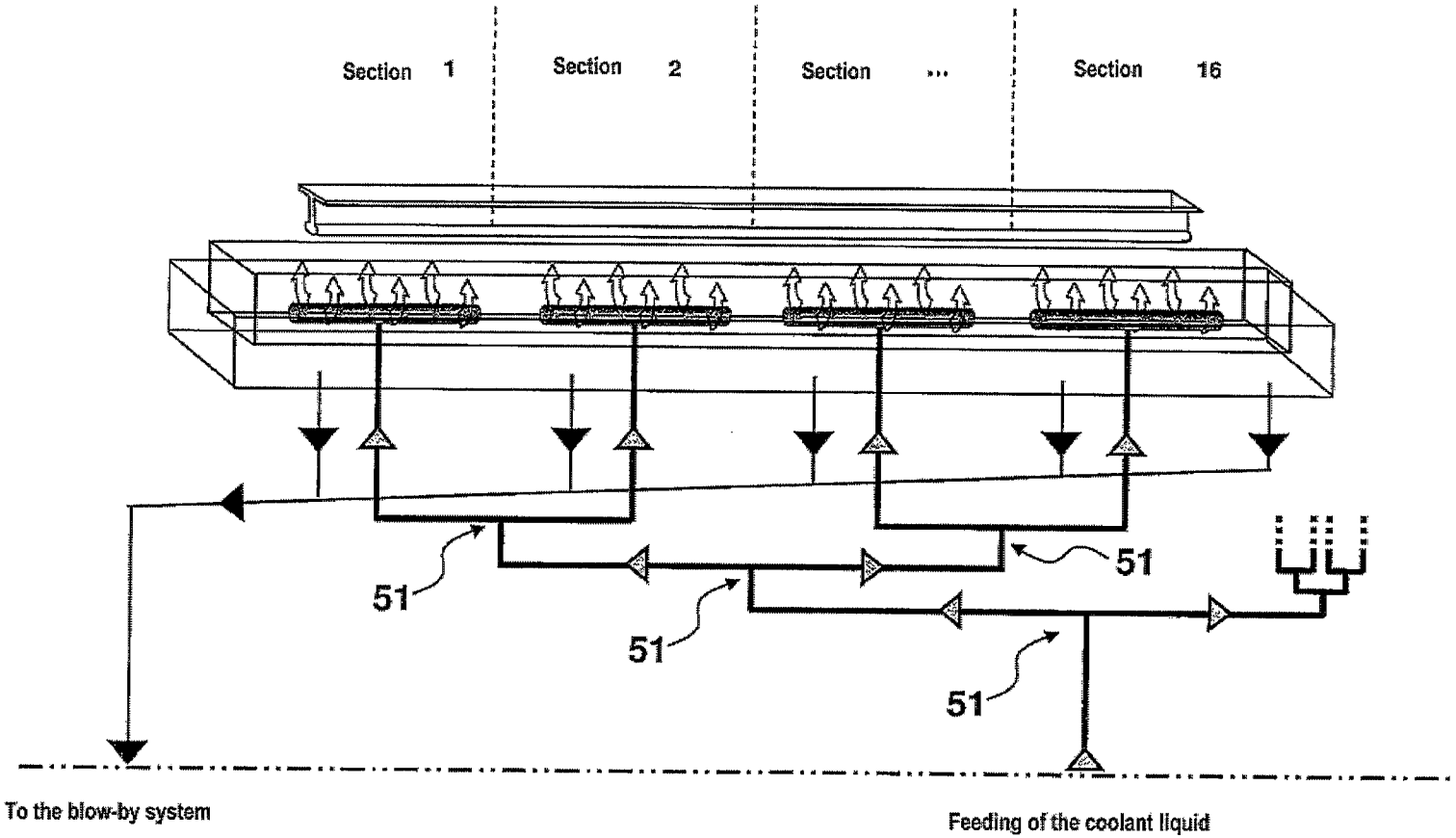
FIG. 8 shows a diagram of a delivery circuit of the cooling fluid to the moduli of the cooling tank.

Advantageously the moduli may be supplied by means of a delivery circuit of the cooling fluid which provides symmetrical branches 51, in numbers equal to a power of two, and therefore a uniform distribution of the flow between the moduli, as illustrated in the diagram of FIG. 8.

In the case in which the number of moduli comprising the tank is not also equal to a power number of two, the end moduli of the tank exceeding the highest number of moduli which is a power of two, are connected to the delivery pump of the delivery circuit by means of a manual or automatic flow regulating valve, whereas the remaining central moduli of a number equal to a power of two are connected to symmetrical branches 51 coming from the pump itself.

Each modulus 1 is provided with a fluid inlet pipe 50 arranged sideways and centrally with respect to the longitudinal extension of the modulus. This inlet pipe 50 is connected to a delivery manifold 2, which, downstream from a first section defining an axis perpendicular to the longitudinal axis of the tank, provides a fork with two longitudinal sections 2' parallel to said longitudinal axis which extend to the side ends 19 of the modulus. Inlet pipe 50 and delivery manifold 2 may be made as a single piece.

The two longitudinal sections 2' are closed at the side ends 19. The longitudinal sections 2' in essence advantageously have a polygonal section, preferably square, and are provided with a plurality of gauged side holes 21. The gauged holes 21 are provided close to the upper ends of the vertical sides 22 of the longitudinal sections 2'. The holes 21 are of equal number on both the sides 22 and the axis defined by each of the holes 21 on one of the two sides 22 may be at the axis of a respective hole 21 on the other of the two sides 22.

The fact of combining a square section of sections 2' with the gauged holes 21 in this particular configuration avoids the formation of air locks in the upper part of the longitudinal sections 2'.

Figure 7:
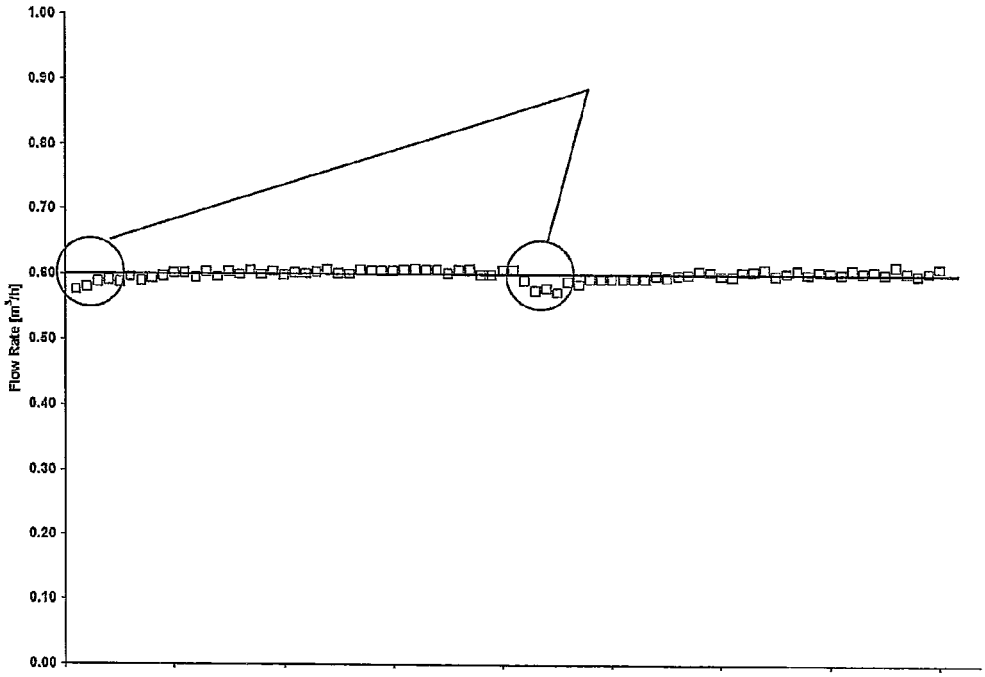
FIG. 7 shows the distribution of the flow of cooling fluid for each hole on the delivery manifold.

FIG. 7 illustrates a diagram in which the flow distribution is visible in $m^3/h$ for each gauged hole 21 of the delivery manifold. Each small square shows the value of the outlet flow from a respective hole 21. The small squares inside the circles drawn on the diagram refer to the holes 21 placed close to the inlet pipes 50 to the tank.

The delivery manifold 2 comprising the two longitudinal sections 2' is placed in the lower part of the central volume 31.

At least one extractable basket 3 is provided inside the central volume 31 of each modulus 1 of the cooling tank.

A single basket 3 may be provided having a longitudinal extension equal to that of the modulus 1 or a plurality of baskets 3 may be provided such that the sum of their longitudinal extensions is equal to that of the modulus 1.

Such baskets 3 occupy the upper part of the central volume 31 and have a frame such that, in cooperation with the aforesaid configuration of the longitudinal sections 2' of the delivery manifold 2, they determine a stable upwards and on average uniform flow of the cooling fluid along the entire modulus, with a relative fluid-surface speed at the head of the rail such as to uniform and optimize the cooling speed of the head of the rail.

Figure 2:
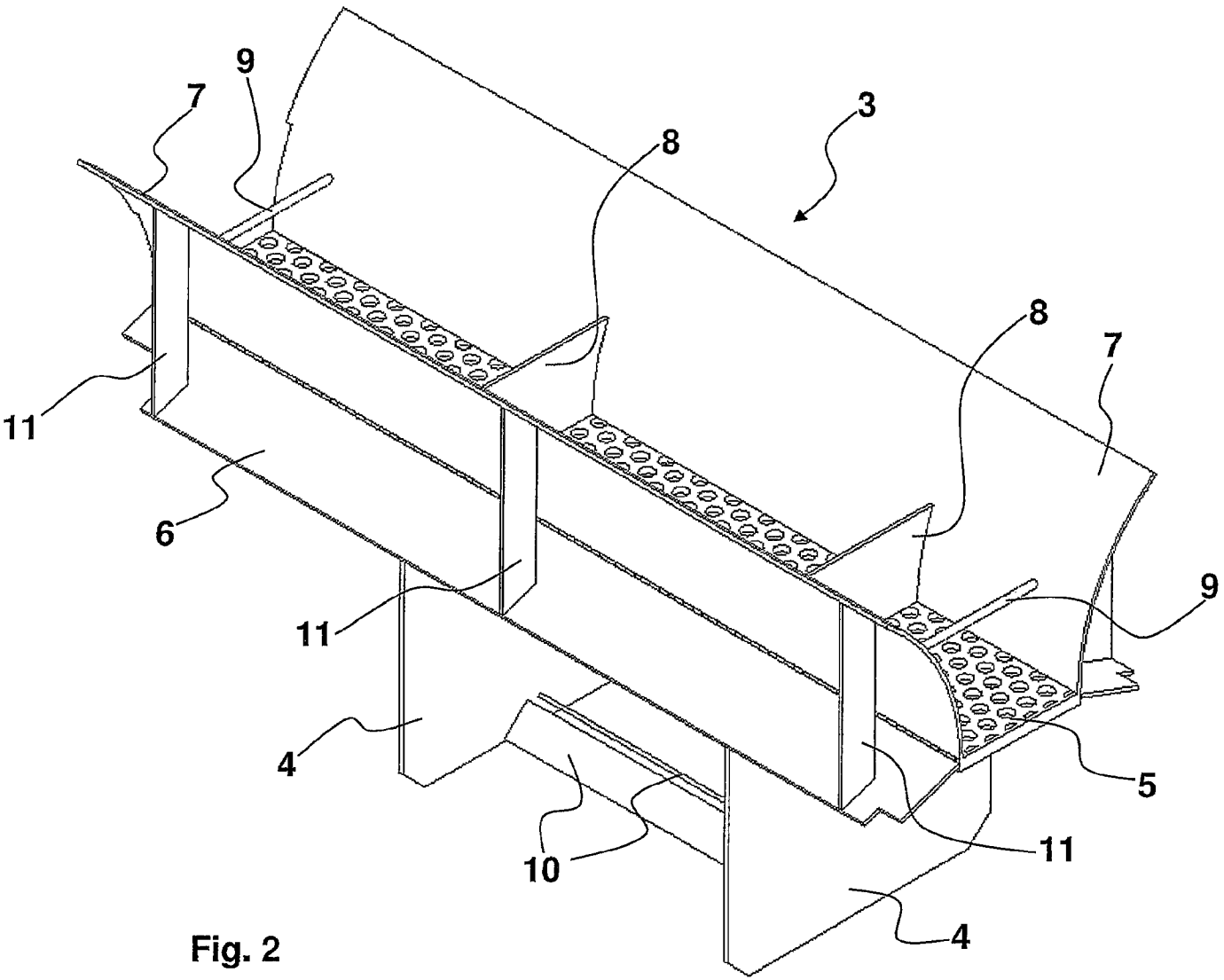
FIG. 2 shows a perspective view of a component of a modulus of the tank according to the invention.
Figure 3:
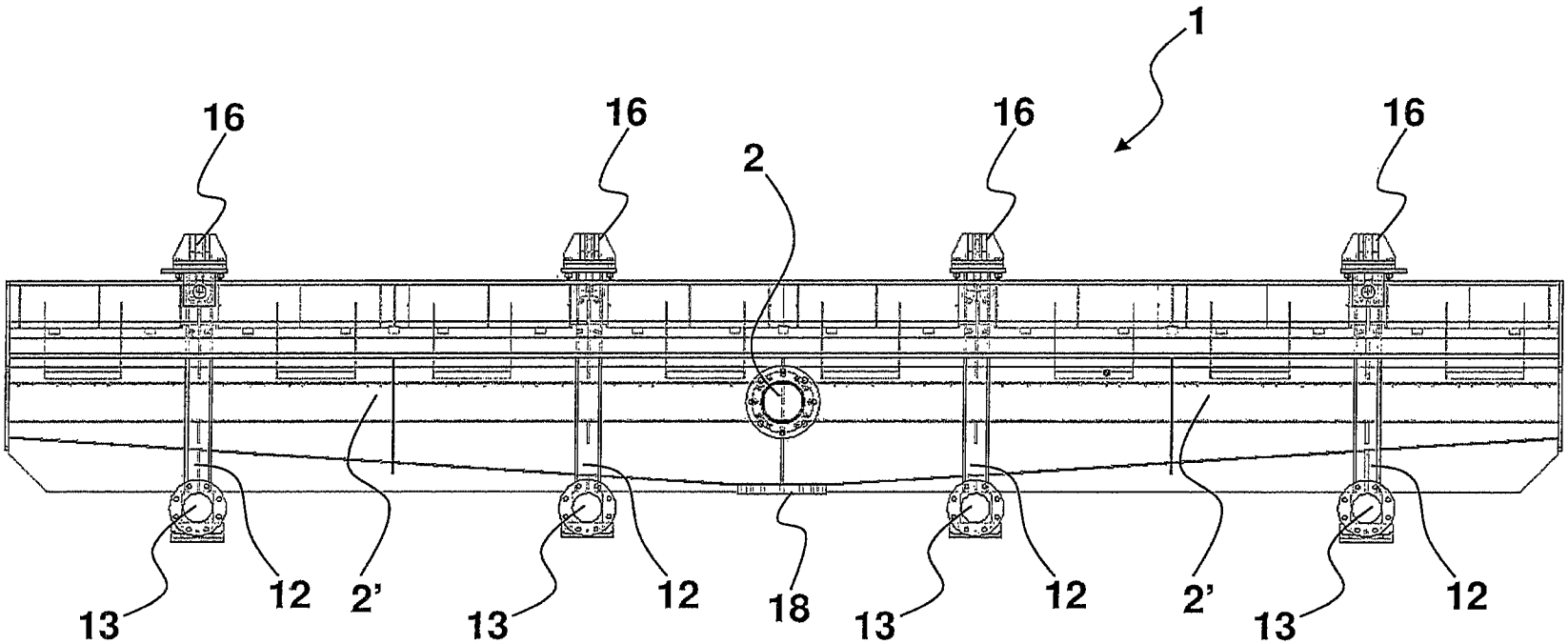
FIG. 3 shows a side view of a modulus of the tank according to the invention.

In a preferred variant each basket 3 comprises partitions or lower deflectors 4 and respective partitions or upper deflectors 8 (FIG. 2). Each couple of deflectors comprising an upper deflector 8 and a respective lower deflector 4 lies on the same plane transversal to the underlying longitudinal section 2' of the delivery manifold.

Lower 4 and upper deflectors 8 are separated from each other by a longitudinal element comprising a central drilled plate 5 integrally locked to two side plates 6. Said side plates 6 are not coplanar with respect to the drilled plate 5 but are sloping downwards with respect to the plane defined by the drilled hole 5 of a predetermined angle, e.g. equal to 5-15°.

Figure 4:
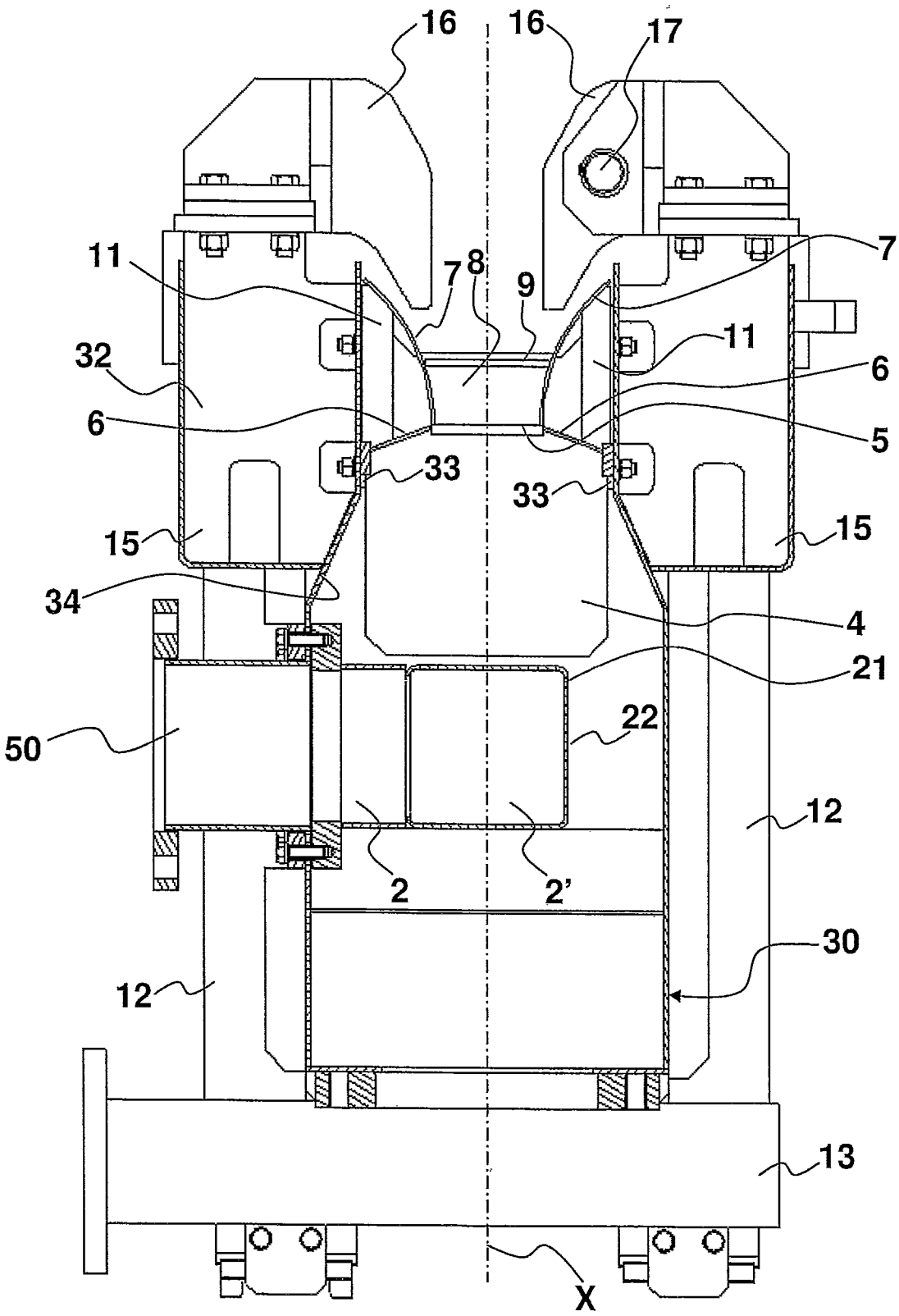
FIG. 4 shows a cross section of the modulus of the tank in FIG. 1*b;*
Figure 5:
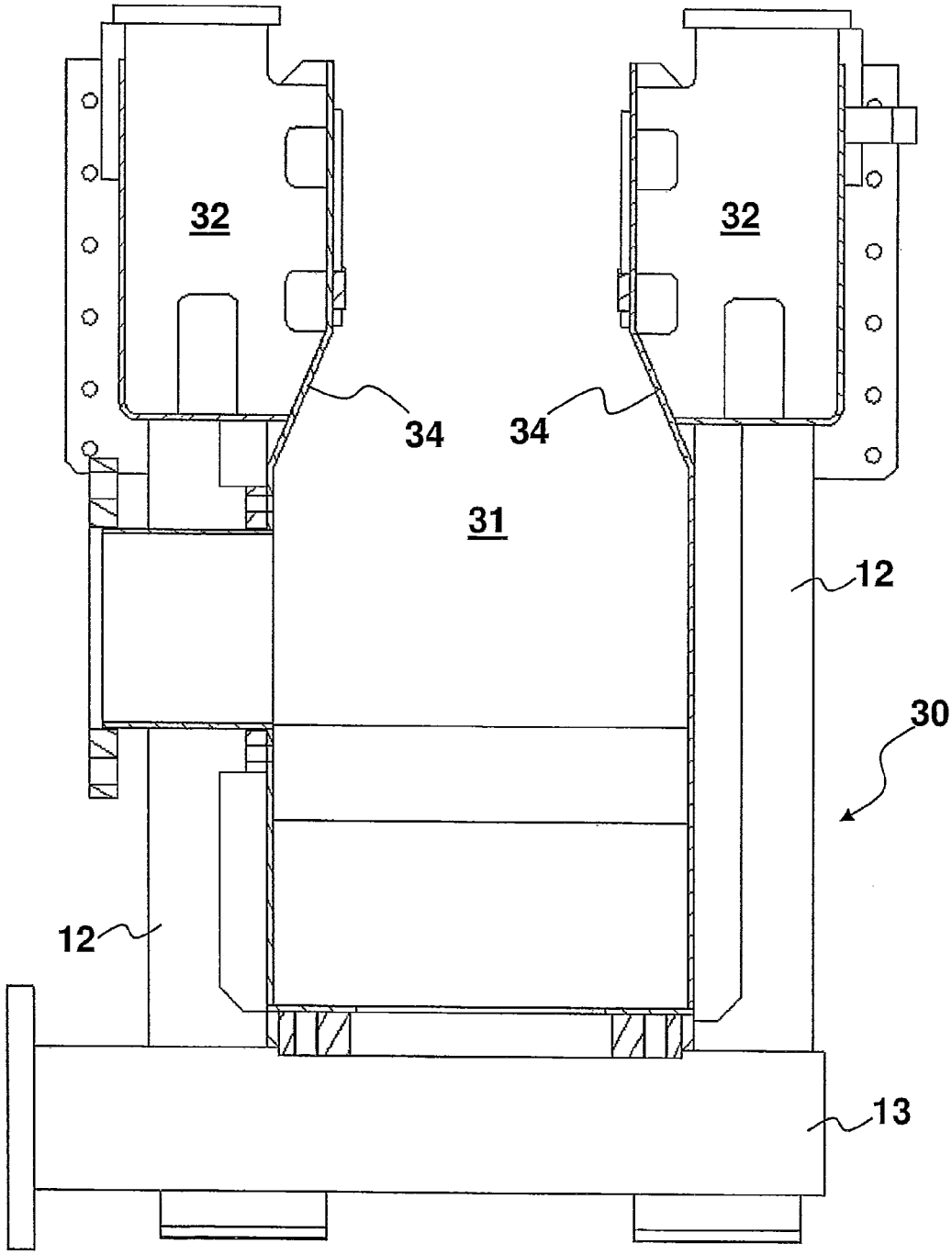
FIG. 5 shows a cross section of the modulus of the tank in FIG. 1*a;*

The position of the baskets 3 inside the moduli of the tank of the invention is determined by resting the side plates 6 on suitable protrusions 33 of the internal walls of the base frame 30. The dimension of the baskets 3 and the position of the protrusions 33 is such that the lower deflectors 4 are completely above the delivery manifold 2 when the baskets are completely inserted in the moduli of the tank (FIG. 4).

The lower deflectors 4 define, together with internal walls of the central volume (31), first compartments below the drilled plate 5. An equal number of gauged holes 21 is provided at each of said first compartments in the underlying portion of longitudinal sections 2' of the delivery manifold 2.

Further longitudinal elements of the basket 3 are provided at the joints between the drilled plate 5 and side plates 6, not drilled, above the drilled plate 5. Said further longitudinal elements in essence are curvilinear walls 7, convex with regard to the central line longitudinal plane (X) of the modulus, and the upper deflectors 8, transversal to said curvilinear walls 7, together with said walls 7 define second compartments above the drilled plate 5. In the example in FIG. 2, there are two lower 4 and upper deflectors 8 for each basket 3.

Figure 6:
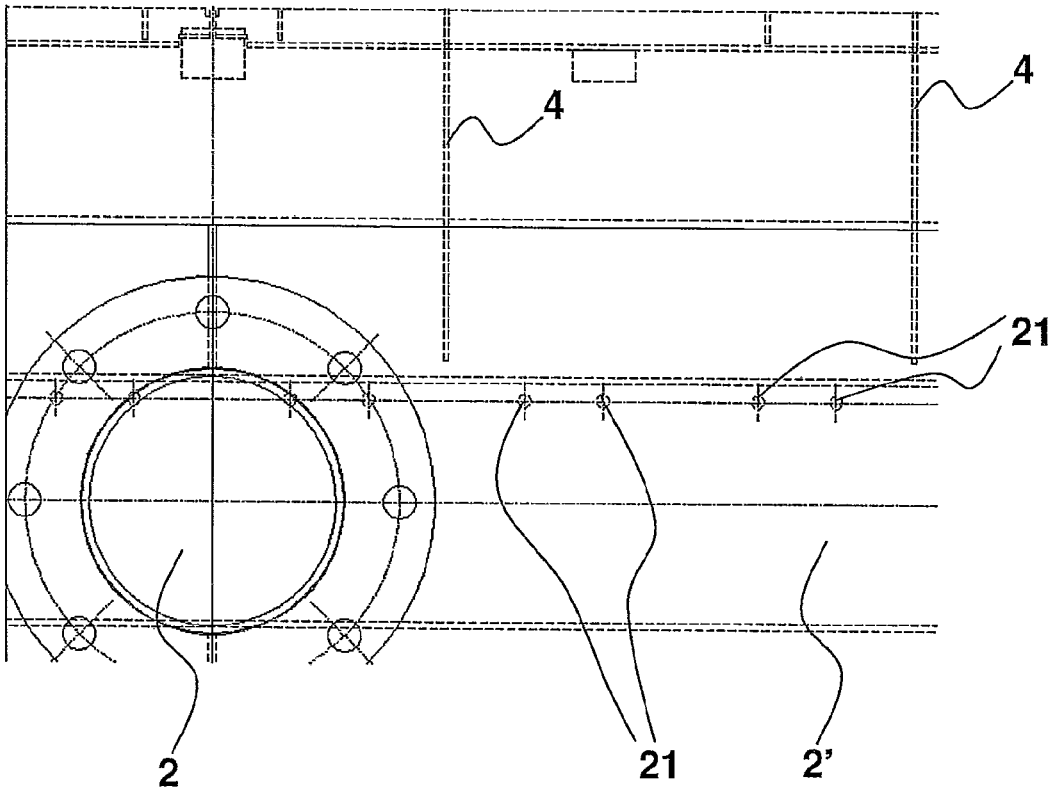
FIG. 6 shows a detail of the side view in FIG. 3.

A suitable choice of the section of the delivery manifold 2 and respective longitudinal sections 2' as well as the number and dimension of the holes 21 in essence obtains an equal distribution, along the entire longitudinal development of the sections 2', of the outlet flows from said holes, thus permitting flow uniformity. The holes 21 have a pitch equal to or a submultiple of the distance between the partitions or lower deflectors 4, between 20 and 400 mm. Said pitch may be constant or alternating. In the example in FIG. 6 the holes 21 have an alternating pitch with values of 50 and 100 mm and the distance between the partitions 4 is equal to 300 mm. The holes 21 have a diameter between 2 and 20 mm, preferably equal to 5÷10 mm, and the delivery manifold 2 has a section between 80×80 $mm^2$ and 250×250 $mm^2$, preferably equal to 150×150 $mm^2$.

The cooling fluid continuously enters the delivery manifold 2, and therefore enters the two longitudinal sections 2', at a predetermined first pressure, e.g. 0.05÷5 bar, and leaves at a predetermined second pressure, at least equal to the piezometric charge exerted by the impending hydraulic head of the fluid through the plurality of gauged holes 21, in the lower part of the central volume 31.

At speed, the fluid jets outlet from the holes 21 result in the fluid moving from this lower part upwards, i.e. in the first compartments defined by the lower deflectors 4 which, advantageously, avoid the formation of longitudinal currents in the modules, and therefore in the tank.

The flow of fluid is directed towards the drilled plate 5, also due to the inducement action both of the converging portions 34 of the internal walls of the base frame 30 and of the sloping side plates 6, and reaches the second compartments through the holes 40 of said plate 5. The inclination of the side walls 6 advantageously avoids the formation of air locks in the first compartments which over time would cause undesired releases of air in the fluid which touches the head of the rail immersed in the tank.

Advantageously the drilled plate 5 permits cancelling the effect of unstable transversal vortexes which are created in the lower compartments in the transfer from the first to the second compartments; moreover, the drilled plate 5 permits dampening the speed fluctuations of the fluid in the second compartments, which, according to the preferred embodiment of the present invention, does not exceed 10 cm/sec.

The upper deflectors 8 contribute to obtaining an on average uniform upwards flow; the curvilinear walls 7 minimize any fluid stagnation areas and progressively accompany the fluid towards the upper edges of the tank.

Thus, with the frame of the tank of the invention, a continuous on average upwards flow is obtained which touches the immersed head of the rail with such a relative fluid-surface speed of the head to ensure a constant thermal exchange and therefore make the thermal treatment of the head itself homogeneous along the entire length of the rail.

Restraint elements 16 are advantageously locked at the discharge pipes 12, above the side volumes 32, adjustable in height by means of shims, which define between each other a through hole for the head of the rail, said hole in essence having a funnel shape. Said restraint elements 16 perform the function of stopper for the rail during the insertion thereof inside the cooling tank, thus preventing the sudden and excessive immersion of parts of the rail into the tank. They, e.g., avoid the excessive immersion of parts of the rail when it is heavily curved, especially at the ends. The excessive immersion of a part of the rail into the cooling tank could produce the undesired hardening of the core and variations in the fluid dynamics close to the head.

At least one restraint element 16 of each couple of corresponding restraint elements may rotate around a pin 17, as illustrated in FIG. 4. Such rotation is small and allows being able to extract the rail without problems in the case it is jammed in the funnel-shaped hole due to the excessive curving of the ends.

Advantageously each basket 3 is provided with at least two transversal elements 9 locked to both the curvilinear walls 7, to facilitate the manual extraction of the baskets 3 from the moduli 1 of the tank of the invention. This extraction facilitates the access to the tank for maintenance and cleaning operations.

Each modulus 1 of the cooling tank advantageously has the shape of a hopper (visible in FIG. 3), conferred by the inclination, with a predetermined inclination, of the bottom surface towards its central area in which a discharge pipe 18 is provided with an automatic opening and closing valve. Due to such conformation of the modulus it is possible to automatically wash the same in order to eliminate all the scale that accumulates on the bottom.

Washing may be performed during brief stops of the installation, such as e.g. during the replacement of rolling machine cylinders, and provides the following phases performed automatically:

a) stopping the main pumps of the fluid delivery circuit;

b) opening the automatic valve of the discharge pipe 18 and discharging the fluid from the bottom of the modulus and sending the same to a cleaning circuit;

c) inletting new fluid from the delivery manifold 2 by means of a part or all the main pumps to free rinse the bottom of the modulus to eliminate the scale residues;

d) closing said automatic valve;

e) inletting fluid from the delivery manifold 2 by means of a part or all the main pumps to fill the tank to restore operativeness before the installation is started up again.

According to a variant of the invention it is also possible to perform the partial automatic washing of the modulus during the production cycle of the installation. In this case the inter-billet time is taken advantage of (between 0.5 min. to 4 min.) between one rail and the successive and aforesaid phases b) and d) are implemented, therefore without interrupting the operation of the main pumps of the fluid delivery circuit, and phase b) is adequately temporized for partial emptying of the tank which results in a slight and temporary reduction of the fluid level.

The invention claimed is:

1. A cooling tank for a thermal treatment of a head of a rail, the cooling tank defining a longitudinal axis, the cooling tank comprising at least one longitudinal modulus comprising:

a frame having a central volume to be filled with a cooling fluid wherein the head of the rail to be treated is immersed;

a delivery manifold for an inlet of the cooling fluid placed in a lower area of the central volume;

two second volumes disposed laterally with respect to the central volume for collecting the cooling fluid when the cooling fluid overflows from a top of the central volume;

wherein said two second volumes a plurality of pairs of discharge pipes disposed along the longitudinal extension of the two second volumes, the discharge pipes of each pair being connected to a same further pipe, arranged transversal with respect to said discharge pipes of each pair and below a bottom of the at least one modulus and on its turn connected to a blow-by circuit of the cooling fluid;

wherein pairs of restraint elements are disposed above the second volumes, each restraint element being locked to a respective discharge pipe, each pair of the restraint elements being adjustable in height and defining a space for the passage of the head of the rail;

wherein at least one restraint element of each pair of restraint elements is rotatable around a pin; and wherein the tank comprises a plurality of longitudinal moduli connected in succession to each other at their respective ends.

2. The tank according to claim 1, wherein the moduli define side ends, said delivery manifold is provided with a bifurcation with two longitudinal sections parallel to said longitudinal axis, which extend up to the side ends of the moduli and which are closed at said side ends, wherein said longitudinal sections have two opposed side walls provided with a respective plurality of gauged holes close to the upper ends of the side walls of the longitudinal sections and have the same number on both said side walls, so that a substantially even distribution of the discharge coming out of said gauged holes is obtained, thus allowing an evenness of the cooling fluid flow along each modulus.

3. The tank according to claim 1, wherein inside the central volume of each longitudinal modulus at least an extractable basket placed in an upper area of said central volume is provided.

4. The tank according to claim 3, wherein said at least one extractable basket comprises at least two couples of deflectors, each couple being formed by an upper deflector and by a lower deflector lying on the same plane transversal to the underlying longitudinal section of the delivery manifold.

5. The tank according to claim 4, wherein the lower deflectors and the upper deflectors are separated by a first longitudinal element comprising a central drilled plate integrally locked to two side plates sloping downwards with regard to a plane defined by said central drilled plate.

6. The tank according to claim 5, wherein the position of said at least one basket inside a modulus of the tank is determined by means of protrusions of internal walls of the frame on which said side plates rest.

7. The tank according to claim 6, wherein the dimension of said at least one basket and the position of the protrusions is such that the lower deflectors are completely above the delivery manifold when said at least one basket is completely inserted into the modulus of the tank.

8. The tank according to claim 5, wherein the lower deflectors define, together with internal walls of the central volume, compartments below the central drilled plate corresponding to an equal number of gauged holes in an underlying portion of longitudinal sections.

9. The tank according to claim 8, wherein, above the central drilled plate, in correspondence to joints between said central drilled plate and the side plates, curvilinear longitudinal walls, convex with regard to a central line longitudinal plane of the modulus, are provided.

10. The tank according to claim 1, wherein the longitudinal moduli are feedable through a delivery circuit of the cooling fluid provided with symmetrical branches having a number equal to a power of two and, in the case wherein the number of moduli composing the tank is not equal to a power of two, the end moduli of the tank exceeding the highest number which is a power of two are connected to a delivery pump of the delivery circuit by means of a flow regulating valve, whereas the remaining moduli are connected to said symmetrical branches coming from said delivery pump.

11. The tank according to claim 1, wherein each longitudinal modulus has the shape of a hopper conferred by the inclination of the bottom surface towards its central area and a discharge pipe having an automatic opening and closing valve.

12. The tank according to claim 1 further comprising sliding blocks on longitudinal moduli for allowing thermal expansion of the tank, and only at least one central modulus of said plurality of longitudinal moduli is locked without the possibility of moving.

13. A method for thermal treatment of a head of a rail by means of a cooling tank, according to claim 2, comprising the following steps:

continuously flowing in of the cooling fluid in the delivery manifolds of each modulus at a predetermined first pressure;

flowing outlet of said cooling fluid into the lower area of the first volume of each modulus, at a predetermined second pressure at least equal to a piezometric charge exerted by an impending hydraulic head of the fluid through the plurality of gauged holes of the longitudinal sections of said delivery manifolds, so that a substantially even distribution of the flow coming out of said gauged holes is obtained, thus allowing an evenness of flow of the cooling fluid along each modulus.

14. The method of a cooling tank according to claim 1, comprising the following steps:

a) opening a discharge pipe provided on the bottom of each modulus of the tank by means of a respective valve of opening/closing and discharging, at least partially, the fluid present in the modulus;

b) closing said respective opening/closing valve.

15. The method according to claim 14, further comprising the steps of:

shutting down at least one delivery pump of a delivery circuit of cooling fluid before step a);

delivering new cooling fluid into the delivery manifolds between step a) and step b) by activating said at least one delivery pump to carry out a free rinse of the bottom of each modulus to get rid of residual scale; and delivering new cooling fluid into the delivery manifolds after step b) by activating said at least one delivery pump to carry out the filling of the tank and to restore its ability of operation.

16. A cooling tank for a thermal treatment of a head of a rail, defining a longitudinal axis, comprising at least one longitudinal modulus comprising:

a frame having a central volume to be filled with a cooling fluid wherein the head of the rail to be treated is immersed;

a delivery manifold for an inlet of the cooling fluid, placed in a lower area of said central volume;

two second volumes, lateral with respect to said central volume, for collecting the cooling fluid when it overflows from the top of said central volume;

wherein said two second volumes are provided, along their longitudinal extension, with a plurality of pairs of discharge pipes, the discharge pipes of each pair being connected to a same further pipe, arranged transversal with respect to said discharge pipes of each pair and below a bottom of the at least one modulus and on its turn connected to a blow-by circuit of the cooling fluid;

wherein pairs of restraint elements are disposed above the second volumes, each pair of the restraint elements being adjustable in height and defining a space for a passage of the head of the rail;

wherein at least one restraint element of each pair of restraint elements is rotatable around a pin;

wherein the tank comprises a plurality of longitudinal moduli connected in succession to each other at their respective ends; and wherein sliding blocks on the longitudinal moduli for allowing thermal expansion of the tank, and only at least one central modulus of said plurality of longitudinal moduli is locked without the possibility of moving.

* * * * *